US009916780B2

(12) United States Patent
Chang et al.

(10) Patent No.: US 9,916,780 B2
(45) Date of Patent: Mar. 13, 2018

(54) LIGHT-EMITTING ASSEMBLY AND DISPLAY DEVICE

(71) Applicant: LEYARD OPTOELECTRONIC CO., LTD., Beijing (CN)

(72) Inventors: Ming Chang, Beijing (CN); Baohong Yan, Beijing (CN)

(73) Assignee: LEYARD OPTOELECTRONIC CO., LTD., Beijing (CN)

( * ) Notice: Subject to any disclaimer, the term of this patent is extended or adjusted under 35 U.S.C. 154(b) by 0 days.

(21) Appl. No.: 15/257,829

(22) Filed: Sep. 6, 2016

(65) Prior Publication Data

US 2017/0345347 A1 Nov. 30, 2017

(30) Foreign Application Priority Data

May 30, 2016 (CN) ..... 2016 1 0371149

(51) Int. Cl.

| | |
|---|---|
| ***F21V 7/04*** | (2006.01) |
| ***G09F 13/14*** | (2006.01) |
| ***F21V 7/00*** | (2006.01) |
| ***F21V 3/04*** | (2018.01) |
| ***G09F 15/00*** | (2006.01) |
| ***G09F 9/30*** | (2006.01) |
| *G09F 13/04* | (2006.01) |

(52) U.S. Cl.

CPC ..... *G09F 13/14* (2013.01); *F21V 3/049* (2013.01); *F21V 7/0008* (2013.01); *G09F 9/30* (2013.01); *G09F 15/0037* (2013.01); *G09F 2013/0422* (2013.01); *G09F 2013/0431* (2013.01); *G09F 2013/142* (2013.01)

(58) Field of Classification Search

CPC ..... G09F 13/14; G09F 15/037; G09F 9/30; F21V 7/0008; F21V 3/049

See application file for complete search history.

(56) References Cited

U.S. PATENT DOCUMENTS

2014/0111973 A1* 4/2014 Wang He ..... G02B 27/0927 362/97.1

* cited by examiner

*Primary Examiner* — Thomas M Sember

(74) *Attorney, Agent, or Firm* — Knobbe, Martens, Olson & Bear, LLP

(57) ABSTRACT

Disclosed embodiments relate to a light-emitting assembly and a display device. In some embodiments, the light-emitting assembly includes a lamp bead a lamp bead mounting plate and a lamp bead shading face mask, the lamp bead shading face mask covering the lamp bead, and there is a distance between the lamp bead shading face mask and the lamp bead, at least two side faces of the lamp bead shading face mask including light emergence holes, wherein one side, facing the lamp bead mounting plate, of the lamp bead shading face mask is provided with a first reflecting surface; one side, facing the lamp bead shading face mask, of the lamp bead mounting plate is provided with a second reflecting surface; and light emitted by the lamp bead is reflected by the first reflecting surface and the second reflecting surface and then emitted out of each of the light emergence holes.

13 Claims, 4 Drawing Sheets

LIGHT-EMITTING ASSEMBLY AND DISPLAY DEVICE

CROSS REFERENCE TO RELATED APPLICATIONS

This application claims the benefit of Chinese Patent Application No. 201610371149X, filed on May 30, 2016, which is hereby incorporated by reference in its entirety.

TECHNICAL FIELD

The disclosure relates to the technical field of display devices, and in particular to a light-emitting assembly and a display device.

BACKGROUND

As shown in FIG. 1 to FIG. 3, a single-faced display device 1 is adopted in the prior art. That is, a viewer 2 can view only from a front face (single face) of the display device, and a maximum viewing angle cannot exceed 160° even if the viewer views from a side face. When viewing from the side face, the viewer 2 will be affected by factors such as an optimal viewing angle. In such a way, the viewer 2 obtains poor viewing quality of image display.

The single-faced display device 1 is relatively single in functionality, the viewer cannot view from a back face thereof spatially, and therefore the utilization rate of the single-faced display device 1 is reduced. In the case of a double-faced image display demand, it is often necessary to mount two screens back to back so as to meet the demand. This method increases the input cost and wastes resources.

SUMMARY

A main objective of some embodiments of the disclosure is to provide a light-emitting assembly and a display device, which are intended to solve the problem in the traditional art that a viewing angle of a light-emitting assembly is relatively small.

To this end, according to one aspect of some embodiments of the disclosure, a light-emitting assembly is provided, which comprises: a lamp bead; a lamp bead mounting plate, the lamp bead is mounted on the lamp bead mounting plate; and a lamp bead shading face mask, the lamp bead shading face mask is connected with the lamp bead mounting plate, the lamp bead shading face mask covering the lamp bead and there is a distance between the lamp bead shading face mask and the lamp bead, at least two side faces of the lamp bead shading face mask including light emergence holes, wherein one side, facing the lamp bead mounting plate, of the lamp bead shading face mask is provided with a first reflecting surface; one side, facing the lamp bead shading face mask, of the lamp bead mounting plate is provided with a second reflecting surface; and light emitted by the lamp bead is reflected by the first reflecting surface and the second reflecting surface and then emitted out of each of the light emergence holes.

Furthermore in some embodiments, the light emergence holes are provided at two opposite sides of the lamp bead shading face mask.

Furthermore in some embodiments, the light-emitting assembly further comprises a transparent block, at least a portion of the transparent block is provided between the lamp bead mounting plate and the lamp bead shading face mask.

Furthermore in some embodiments, the transparent block is made from a light-transmitting glass material.

Furthermore in some embodiments, the transparent block is filled in a space between the lamp bead mounting plate and the lamp bead shading face mask, and the transparent block is provided with a light emergence face which is frosted so as to form diffuse reflection to emergent light.

Furthermore in some embodiments, the lamp bead mounting plate is of a long plate structure, the lamp bead shading face mask is adaptive to the long plate structure, the lamp bead mounting plate and the lamp bead shading face mask form a rectangular structure, there are a plurality of lamp beads which are arranged on the lamp bead mounting plate in a column, the light emergence holes extend in a length direction of the lamp bead mounting plate, and the light emergence holes are provided at two sides of a light emergence direction of the plurality of lamp beads.

Furthermore in some embodiments, the lamp bead shading face mask comprises a partition plate which is provided in the lamp bead shading face mask so as to isolate each of the lamp beads.

Furthermore in some embodiments, there are a plurality of transparent blocks which are provided in one-to-one correspondence to the lamp beads, and the partition plate isolates each of the transparent blocks.

According to another aspect of some embodiments of the disclosure, a display device is provided, which comprises a plurality of light-emitting assemblies, each of the light-emitting assemblies is the above light-emitting assembly.

According to another aspect of some embodiments of the disclosure, a display device is also provided, which comprises a plurality of light-emitting assemblies, each of the light-emitting assemblies is the above light-emitting assembly, the plurality of light-emitting assemblies are superposed.

By applying the technical solution of some embodiments of the disclosure, when lamp beads of a light-emitting assembly emit light, the light is emitted out of light emergence holes, the light emergence holes being provided on at least two side faces of the light-emitting assembly. The structure replaces a traditional structure of light emergence at only the front side of the light-emitting assembly, such that a viewing angle of light emergence is expanded, and the light emergence direction of the light-emitting assembly can be flexibly set as needed. The technical solution of some embodiments of the disclosure effectively solves the problem in the traditional art that a viewing angle of a light-emitting assembly is relatively small.

BRIEF DESCRIPTION OF THE DRAWINGS

The drawings of the specification, forming a part of the disclosure, are used to provide further understanding of the disclosure. The schematic embodiments and illustrations of the disclosure are used to explain the disclosure, and do not form improper limits to the disclosure. In the drawings.

Figure 1:
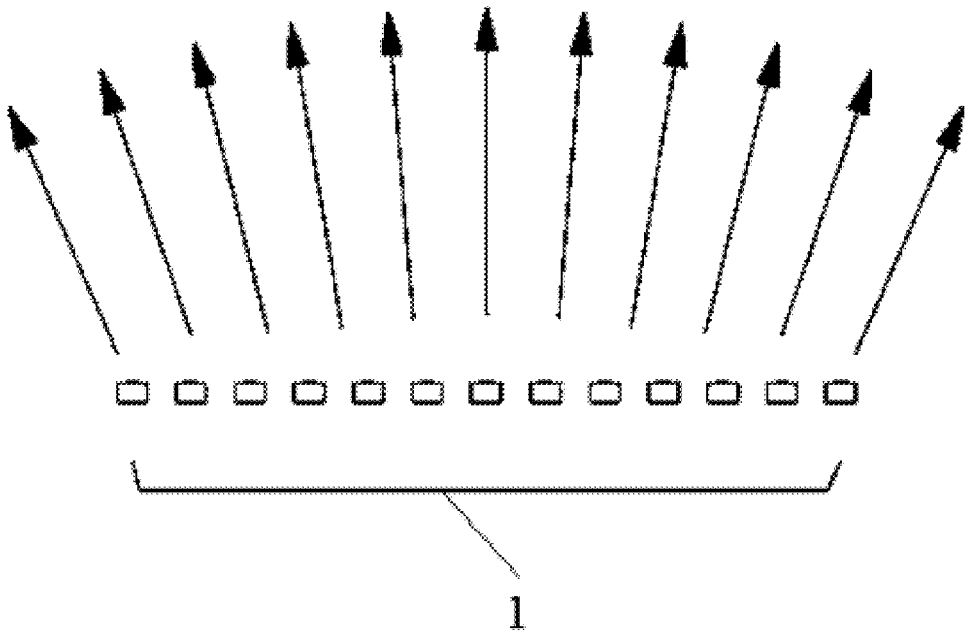
Fig. 1 (PRIOR ART)
FIG. 1 shows a light emergence diagram of some embodiments for a display device according to the prior art.
Figure 2:
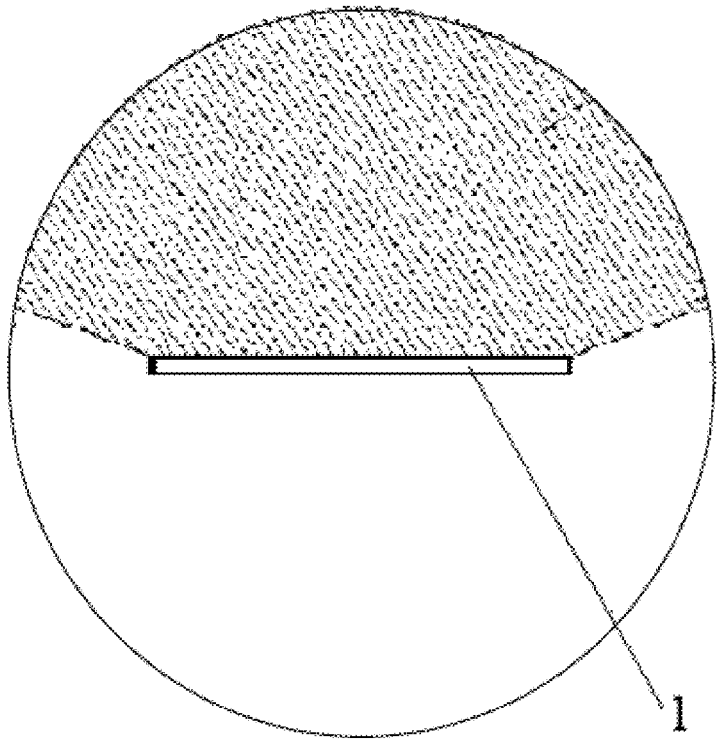
Fig. 2 (PRIOR ART)
FIG. 2 shows a diagram of a light emergence range of a display device in FIG. 1, according to the prior art.

Wherein, the drawings include the following drawing marks:

1, single-faced display device; 2, viewer; 10, lamp bead; 20, lamp bead mounting plate; 21, second reflecting surface; 30, lamp bead shading face mask; 31, light emergence hole; 32, first reflecting surface; 40, transparent block; 41, light emergence face; 50, light path; and 100, display device.

DETAILED DESCRIPTION

It is important to note that some embodiments of the disclosure and the characteristics in some embodiments can be combined under the condition of no conflicts. The disclosure will be illustrated below with reference to the drawings and some embodiments in detail.

It shall be pointed out that the following detailed illustrations are examples and intended to provide further illustrations for the disclosure. Unless otherwise noted, all technical and scientific terms used herein have the same meanings usually understood by those skilled in the art within which the disclosure falls.

In order to facilitate descriptions, space relative terms can be used here. For instance, terms 'over', 'above', 'on an upper surface', 'upper' and the like are used to describe a space position relationship between a device or characteristic and other devices or characteristics shown in the figure. It will be appreciated that the space relative terms are intended to comprise different locations, except locations of the device described in the figure, in usage or operation. For instance, if the device in the figure is inverted, a device described as a device above other devices or constructions or over other devices or constructions will be located below other devices or constructions or under other devices or constructions thereafter. Consequently, the term 'above' may include two locations namely 'above' and 'below'. The device may be positioned in other different modes (rotated for 90 degrees or located at other locations), and space relative descriptions used here are correspondingly explained.

Now, implementations according to the disclosure will be described in more detail with reference to the drawings. However, these implementations can be implemented in various different forms, and shall not be interpreted as implementations only limited to be elaborated here. It will be appreciated that provision of these implementations is intended to make the disclosure thoroughly and completely disclosed, and concepts of these implementations are fully transferred to those skilled in the art. In the drawings, in order to make it clear, the thickness of a layer and the thickness of a region are increased, and the same device is represented by the same drawing mark, such that descriptions thereof will be omitted.

Figure 4:
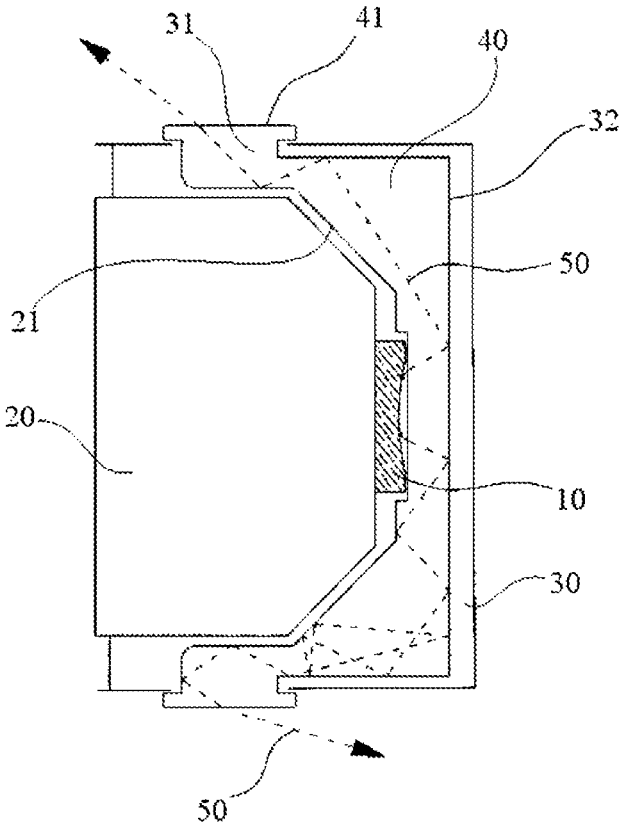
FIG. 4 shows a structural diagram for a light-emitting assembly according to some embodiments of the present disclosure.

As shown in FIG. 4, a light-emitting assembly of the present embodiment comprises: a lamp bead 10, a lamp bead mounting plate 20 and a lamp bead shading face mask 30. The lamp bead 10 is mounted on the lamp bead mounting plate 20. The lamp bead shading face mask 30 is connected with the lamp bead mounting plate 20, the lamp bead shading face mask 30 covers the lamp bead 10, and there is a distance between the lamp bead shading face mask 30 and the lamp bead 10, and at least two side faces of the lamp bead shading face mask 30 is provided with light emergence holes 31. One side, facing the lamp bead mounting plate 20, of the lamp bead shading face mask 30 is provided with a first reflecting surface 32; one side, facing the lamp bead shading face mask 30, of the lamp bead mounting plate 20 is provided with a second reflecting surface 21; and light emitted by the lamp bead 10 is reflected by the first reflecting surface 32 and the second reflecting surface 21 and then emitted out of each of the light emergence holes 31.

By applying the technical solution of the present embodiment, when the lamp bead 10 of the light-emitting assembly emits light, the light is emitted out of the light emergence holes 31, the light emergence holes 31 being provided on at least two side faces of the light-emitting assembly. The structure replaces a traditional structure of light emergence at only a front side of the light-emitting assembly, such that a viewing angle of light emergence is expanded, and the light emergence direction of the light-emitting assembly can be flexibly set as needed. The technical solution of the present embodiment effectively solves the problem in the traditional art that a viewing angle of a light-emitting assembly is relatively small.

Certainly, those skilled in the art know that the light emitted by the lamp bead 10 can be emitted out of the light emergence holes 31 in the case that a certain angle must be formed between the light emitted by the lamp bead 10 and the first reflecting surface 32. In order to form the certain angle between the light emitted by the lamp bead 10 and the first reflecting surface 32, the lamp bead 10 emitting the light can be provided on an inclined surface, as shown in FIG. 4. In such a way, it can be ensured that the light emitted by the lamp bead 10 is emitted out of the light emergence holes 31 under the fit between the first reflecting surface 32 and the second reflecting surface 21. The light emitted by the lamp bead 10 and the first reflecting surface 32 can be in other set forms. For instance, the first reflecting surface 32 may be set to be of an inclined structure.

As shown in FIG. 4, in the technical solution of the present embodiment, the light emergence holes 31 are provided at two opposite sides of the lamp bead shading face mask 30. In such a way, the light emitted by the lamp bead 10 can be viewed from two opposite sides of the light-emitting assembly. The structure makes it convenient for a viewer to view the light emitted by the lamp bead 10 from the light-emitting assembly. Specifically, a light path 50 is shown in FIG. 4.

As shown in FIG. 4, in the technical solution of the present embodiment, the light-emitting assembly further comprises a transparent block 40, at least a portion of the transparent block 40 being provided between the lamp bead mounting plate 20 and the lamp bead shading face mask 30. In such a way, the transparent block 40 can support the lamp bead shading face mask 30, thereby avoiding influence on a visual effect caused by line deformation of the light emitted out of the light emergence holes 31 by the lamp bead 10 due to the deformation of the first reflecting surface 32 and the second reflecting surface 21. Specifically, the transparent block 40 is made from a light-transmitting glass material. Certainly, those skilled in the art know that the transparent block 40 only needs to satisfy an optical lens for efficiently conducting light, such that the brightness loss of the light can be reduced. Further specifically, the light emergence holes 31 are co-formed by the lamp bead mounting plate 20 and the lamp bead shading face mask 30, two light emergence faces of the transparent block 40 can be located at the outer sides of the light emergence holes 31, and a area of each of the light emergence faces is greater than the size of the corresponding light emergence hole 31. Necks are provided between the light emergence faces of the transparent block 40 and a transparent block body of the transparent block 40, and therefore the outer edges of the light emergence holes 31 can be clamped at the positions of the necks. Certainly, those skilled in the art know that the light emergence holes 31 can be formed for the lamp bead shading face mask 30. That is, the side edges of the lamp bead shading face mask 30 are dug to form the light emergence holes 31.

As shown in FIG. 4, in the technical solution of the present embodiment, the transparent block 40 is filled in a space between the lamp bead mounting plate 20 and the lamp bead shading face mask 30, and the transparent block 40 is provided with a light emergence face 41 which is frosted so as to form diffuse reflection to emergent light. The structure expands, on one hand, a light emergence angle of the light-emitting assembly, and softens, on the other hand, viewing light so as to make the viewer more comfortable.

As shown in FIG. 4, in the technical solution of the present embodiment, the lamp bead mounting plate 20 is of a long plate structure, the lamp bead shading face mask 30 is adaptive to the long plate structure, the lamp bead mounting plate 20 and the lamp bead shading face mask 30 form a rectangular structure, there are a plurality of lamp beads 10 which are arranged on the lamp bead mounting plate 20 in a column, the light emergence holes 31 extend in a length direction of the lamp bead mounting plate 20, and the light emergence holes 31 are provided at two sides of a light emergence direction of the plurality of lamp beads 10. The structure enables light emergence imaging systems, fit to each other, to be provided at the same side of the light-emitting assembly. Certainly, those skilled in the art know that images formed by light emergence at two sides of the same lamp bead mounting plate 20 are identical. Furthermore, a plurality of light emergence holes 31 are provided on each of the two side faces, including the light emergence holes 31, of the light-emitting assembly. Specifically, the number of the light emergence holes 31 of each side face is equal to that of the lamp beads 10. Light emitted by each lamp bead 10 can be emitted out of two light emergence holes 31 corresponding to the lamp bead 10.

As shown in FIG. 4, in the technical solution of the present embodiment, the lamp bead shading face mask 30 comprises a partition plate which is provided in the lamp bead shading face mask 30 so as to isolate each of the lamp beads 10. The structure effectively prevents light emitted by the plurality of lamp beads 10 from interfering mutually.

As shown in FIG. 4, in the technical solution of the present embodiment, there are a plurality of transparent blocks 40 which are provided in one-to-one correspondence to the multiple lamp beads 10, and the partition plate isolate each of the transparent blocks 40. The structure facilitates repair and maintenance of the light-emitting assembly. When a transparent block 40 is damaged, it is only necessary to replace the damaged transparent block 40.

Figure 5:
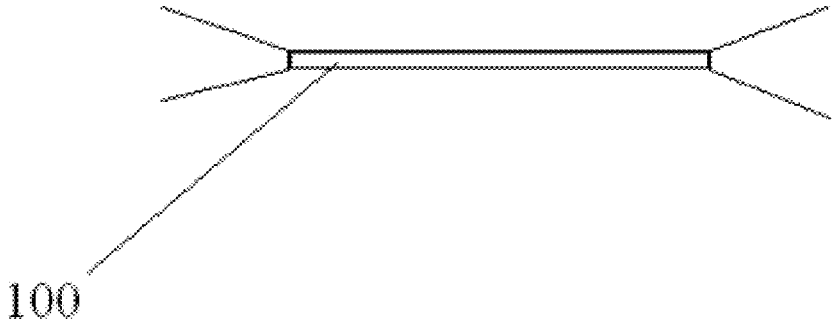
FIG. 5 shows a diagram of a light emergence range of a light-emitting assembly in FIG. 4 according to some embodiments of the present disclosure.
Figure 6:
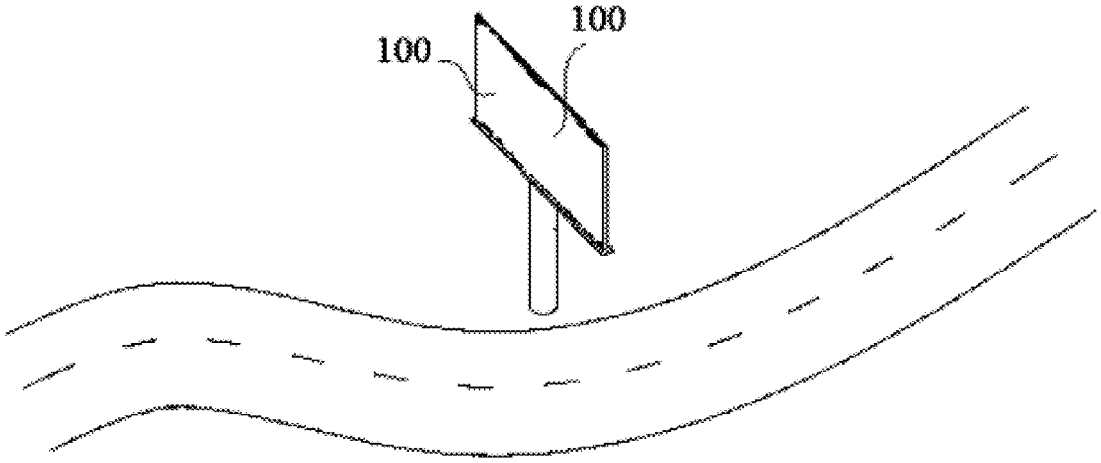
FIG. 6 shows a diagram of a process of assembling light-emitting assemblies in FIG. 5 into a display device according to some embodiments of the present disclosure.

As shown in FIG. 4 to FIG. 6, some embodiments of the disclosure also provides a display device. Some embodiments for the display device according to some embodiments of the disclosure comprises a plurality of light-emitting assemblies, each of the light-emitting assembly is the above light-emitting assembly. The structure aids in forming the whole display screen so as to satisfy display diversity. A light emergence angle of the display device in the prior art is calculated as 140°, and the filling rate of a space during light emergence is 46.7%. The filling rate of light emergence in the present embodiment is 93.4%. In some embodiments of the disclosure, for a 25 mm-interval LED light bar screen, the number of pixel points per square meter is 1600, and the brightness of a single lamp bead is 2 cd, so the brightness of a traditional single-faced display device maximally reaches 3200 cd/m$^2$, and the predictive brightness loss of a lens is approximate to 25%. The brightness of each face of the display device according to some embodiments of the disclosure is: 3200 cd/m$^2$×(1−25%)×0.5=1200 cd/m$^2$. The brightness of each face 1200 cd/m$^2$ completely meets usage requirements. The number of the lamp beads is not increased, and meanwhile, a function of displaying images on double faces can be achieved. The display device in some embodiments of the disclosure can be arranged arbitrarily so as to meet image display demands.

In the display device of the present embodiment, a light-emitting assembly comprises: a lamp bead 10, a lamp bead mounting plate 20 and a lamp bead shading face mask 30. The lamp bead 10 is mounted on the lamp bead mounting plate 20. The lamp bead shading face mask 30 is connected with the lamp bead mounting plate 20, the lamp bead shading face mask 30 covers the lamp bead 10, and there is a distance between the lamp bead shading face mask 30 and the lamp bead 10, and at least two side faces of the lamp bead shading face mask 30 are provided with light emergence holes 31. One side, facing the lamp bead mounting plate 20, of the lamp bead shading face mask 30 is provided with a first reflecting surface 32; one side, facing the lamp bead shading face mask 30, of the lamp bead mounting plate 20 is provided with a second reflecting surface 21; and light emitted by the lamp bead 10 is reflected by the first reflecting surface 32 and the second reflecting surface 21 and then emitted out of each of the light emergence holes 31.

When the lamp bead 10 of the light-emitting assembly of the display device of the present embodiment emits light, the light is emitted out of the light emergence holes 31, the light emergence holes 31 being provided on at least two side faces of the light-emitting assembly. The structure replaces a traditional structure of light emergence at only the front side of the light-emitting assembly, such that a viewing angle of light emergence is expanded, and the light emergence direction of the light-emitting assembly can be flexibly provided as needed. The technical solution of the present embodiment effectively solves the problem in the traditional art that a viewing angle of a light-emitting assembly is relatively small.

Figure 3:
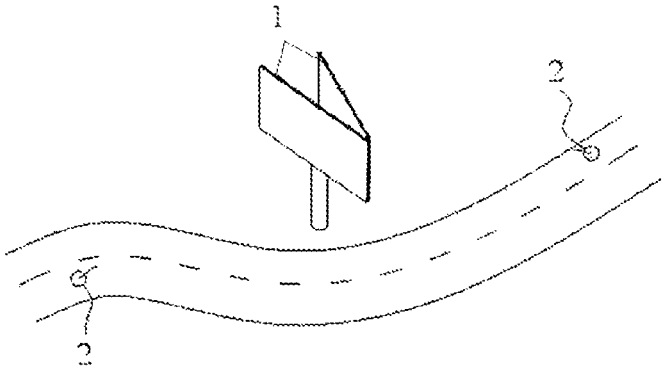
Fig. 3 (PRIOR ART)
FIG. 3 shows a diagram of a display device in FIG. 1 in a usage state, according to the prior art.

As shown in FIG. 4 to FIG. 6, some embodiments of the disclosure also provides a display device. Some embodiments for the display device according to the disclosure comprises a plurality of light-emitting assemblies, each of the light-emitting assemblies is the above light-emitting assembly. The plurality of light-emitting assemblies are superposed. After the multiple light-emitting assemblies of the display device are superposed, light emergence screens at two opposite sides are formed. The structure can be provided at a needed position as needed. For instance, as shown in FIG. 3, a billboard on an expressway in the priori art usually comprises two single-faced display devices 1 provided back to back. In such a way, a viewer 2 can see information about the billboard by viewing in any direction of the expressway. However, the structure is relatively high in manufacturing cost and relatively complicated to mount. As shown in FIG. 6, two single-faced display devices 1 disposed back to back in the prior art can be implemented using only one display device 100 in some embodiments of the disclosure. In addition, the two single-faced display devices 1 provided back to back in the prior art include a certain angle. Two opposite faces of the display device 100 in some embodiments of the disclosure are parallel, but a light path 50 can meet a viewing requirement by setting a reasonable reflecting angle between a first reflecting surface 32 and a second reflecting surface 21. Specifically, a certain angle can be formed between light emitted from two opposite surfaces of the display device 100 and two opposite surfaces of the display device 100 by providing reflecting angles of the first reflecting surface 32 and the second reflecting surface 21. In some embodiments of disclosure can be applied to a billboard of a restaurant (not shown in the figure). Similarly, it is unnecessary to provide two single-faced display devices 1, and the some embodiments of disclosure can be adjusted according to the reflecting angles of the first reflecting surface 32 and the second reflecting surface 21 so as to meet usage demands for different viewing angles.

In the display device of the present embodiment, a light-emitting assembly comprises: a lamp bead 10, a lamp bead mounting plate 20 and a lamp bead shading face mask 30. The lamp bead 10 is mounted on the lamp bead mounting plate 20. The lamp bead shading face mask 30 is connected with the lamp bead mounting plate 20, the lamp bead shading face mask 30 covers the lamp bead 10, and there is a distance between the lamp bead shading face mask 30 and the lamp bead 10, and at least two side faces of the lamp bead shading face mask 30 include light emergence holes 31. One side, facing the lamp bead mounting plate 20, of the lamp bead shading face mask 30 is provided with a first reflecting surface 32; one side, facing the lamp bead shading face mask 30, of the lamp bead mounting plate 20 is provided with a second reflecting surface 21; and light emitted by the lamp bead 10 is reflected by the first reflecting surface 32 and the second reflecting surface 21 and then emitted out of each of the light emergence holes 31.

When the lamp bead 10 of the light-emitting assembly of the display device of the present embodiment emits light, the light is emitted out of the light emergence holes 31, the light emergence holes 31 are provided on at least two side faces of the light-emitting assembly. The structure replaces a traditional structure of light emergence at only the front side of the light-emitting assembly, such that a viewing angle of light emergence is expanded, and the light emergence direction of the light-emitting assembly can be flexibly provided as needed. The technical solution of the present embodiment effectively solves the problem in the traditional art that a viewing angle of a light-emitting assembly is relatively small.

It is important to note that terms used here are merely used to describe specific implementations and are not intended to limit implementations according to some embodiments of the disclosure. For instance, unless the terms used here are clearly pointed out by the context in addition, a singular form is intended to include a plural form. In addition, it will also be appreciated that when terms 'comprise' and/or 'include' are used in the specification, it is pointed that characteristics, steps, operations, devices, assemblies and/or combinations thereof exist.

It is important to note that the specification and claims of the disclosure and terms 'first', 'second' and the like in the drawings are used to distinguish similar objects, and do not need to describe a specific sequence or a precedence order. It will be appreciated that terms used in such a way may be exchanged under appropriate conditions, in order that some embodiments of the disclosure described here can be implemented in a sequence other than sequences graphically shown or described here. In addition, terms 'include' and 'have' and any inflexions thereof are intended to cover non-exclusive inclusions. For instance, it is not limited for processes, methods, systems, products or devices comprising a series of steps or units to clearly list those steps or units, and other steps or units which are not clearly listed or are inherent to these processes, methods, products or devices may be included instead.

The above is only the embodiments of the disclosure, and is not used to limit the disclosure. There can be various modifications and variations in the disclosure for those skilled in the art. Any modifications, equivalent replacements, improvements and the like within the spirit and principle of the disclosure shall fall within the protective scope of the disclosure. Various components illustrated in the figures may be implemented as hardware and/or software and/or firmware on a processor, ASIC/FPGA, dedicated hardware, and/or logic circuitry. Also, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

The invention claimed is:

1. A light-emitting assembly, comprising:

a lamp bead;

a lamp bead mounting plate, wherein the lamp bead is mounted on the lamp bead mounting plate; and a lamp bead shading face mask, wherein the lamp bead shading face mask is connected with the lamp bead mounting plate, the lamp bead shading face mask covering the lamp bead, and the lamp bead shading face mask is disposed at a distance from the lamp bead, and at least two side faces of the lamp bead shading face mask having light emergence holes, wherein one side, facing the lamp bead mounting plate, of the lamp bead shading face mask comprises a first reflecting surface; one side, facing the lamp bead shading face mask, of the lamp bead mounting plate comprises a second reflecting surface; and the first reflective surface and the second reflective surface reflects light emitted by the lamp bead and the light emitted out of each of the light emergence holes, wherein the light emergence holes are provided at two opposite sides of the lamp bead shading face mask, wherein the light-emitting assembly further comprises a transparent block, wherein at least a portion of the transparent block is provided between lamp bead mounting plate and the lamp bead shading face mask, and wherein the transparent block is filled in a space between the lamp bead mounting plate and the lamp bead shading face mask, and the transparent block is provided with a light emergence face which is frosted so as to form diffuse reflection to emergent light.

2. The light-emitting assembly according to claim 1, wherein the transparent block is made from a light-transmitting glass material.

3. A display device, comprising a plurality of light-emitting assemblies, each of the light-emitting assemblies is the light-emitting assembly according to claim 2.

4. The light-emitting assembly according to claim 1, wherein the lamp bead mounting plate comprises a long plate structure, the lamp bead shading face mask is adaptive to the long plate structure, the lamp bead mounting plate and the lamp bead shading face mask forming a rectangular structure, a plurality of lamp beads which are arranged on the lamp bead mounting plate in a column, the light emergence holes extending in a length direction of the lamp bead mounting plate, and the light emergence holes are provided at two sides of a light emergence direction of the plurality of lamp beads.

5. The light-emitting assembly according to claim 4, wherein the lamp bead shading face mask comprises a partition plate which is provided in the lamp bead shading face mask so as to isolate each of the lamp beads.

6. The light-emitting assembly according to claim 5, further comprising a plurality of transparent blocks which are provided in a one-to-one correspondence to the lamp beads, and the partition plate isolates each of the transparent blocks.

7. A display device, comprising a plurality of light-emitting assemblies, each of the light-emitting assemblies is the light-emitting assembly according to claim 6.

8. A display device, comprising a plurality of light-emitting assemblies, each of the light-emitting assemblies is the light-emitting assembly according to claim 6, wherein the plurality of light-emitting assemblies are superposed.

9. A display device, comprising a plurality of light-emitting assemblies, each of the light-emitting assemblies is the light-emitting assembly according to claim 5.

10. A display device, comprising a plurality of light-emitting assemblies, each of the light-emitting assemblies is the light-emitting assembly according to claim 5, wherein the plurality of light-emitting assemblies are superposed.

11. A display device, comprising a plurality of light-emitting assemblies, each of the light-emitting assemblies is the light-emitting assembly according to claim 4.

12. A display device, comprising a plurality of light-emitting assemblies, each of the light-emitting assemblies is the light-emitting assembly according to claim 4, wherein the plurality of light-emitting assemblies are superposed.

13. A display device, comprising a plurality of light-emitting assemblies, each of the light-emitting assemblies is the light-emitting assembly according to claim 1.

* * * * *